US006715243B1

(12) United States Patent
Fons

(10) Patent No.: US 6,715,243 B1
(45) Date of Patent: Apr. 6, 2004

(54) METHOD FOR PRODUCTION OF A SILO

(75) Inventor: Bas Fons, Koog A/D Zaan (NL)

(73) Assignee: Jansens & Dieperink B.V., Zaandam (NL)

( * ) Notice: Subject to any disclaimer, the term of this patent is extended or adjusted under 35 U.S.C. 154(b) by 0 days.

(21) Appl. No.: 09/890,385

(22) PCT Filed: Feb. 16, 2000

(86) PCT No.: PCT/NL00/00097

§ 371 (c)(1),
(2), (4) Date: Jul. 30, 2001

(87) PCT Pub. No.: WO00/49249

PCT Pub. Date: Aug. 24, 2000

(30) Foreign Application Priority Data

Feb. 16, 1999 (NL) ..... 1011315

(51) Int. Cl.[7] ..... E04H 7/04

(52) U.S. Cl. ..... 52/192; 52/293.3; 52/741.4; 52/245; 220/4.12; 220/561; 220/565

(58) Field of Search ..... 52/192, 193, 196, 52/245, 248, 249, 223.3, 169.7, 741.4; 220/565–567, 4.12, 561

(56) References Cited

U.S. PATENT DOCUMENTS

| | | | | | |
|---|---|---|---|---|---|
| 1,265,966 | A | * | 5/1918 | Schlafly | 52/245 |
| 1,765,946 | A | * | 6/1930 | Shea | 52/245 |
| 2,684,173 | A | * | 7/1954 | Schmitz | 220/565 |
| 3,193,129 | A | * | 7/1965 | Pfluger et al. | 220/233 |
| 3,224,620 | A | * | 12/1965 | Orr | 52/245 |
| 4,036,390 | A | * | 7/1977 | Morse | 220/4.13 |
| 4,040,218 | A | * | 8/1977 | Stanelle | 52/194 |
| 4,561,222 | A | * | 12/1985 | Fons | 52/194 |
| 4,616,465 | A | * | 10/1986 | Byers et al. | 52/745.01 |
| 4,718,208 | A | | 1/1988 | Fons | |
| 4,760,932 | A | * | 8/1988 | Rhodes, Jr. | 220/4.16 |
| 5,193,321 | A | * | 3/1993 | Edwards | 52/466 |

FOREIGN PATENT DOCUMENTS

| | | | | |
|---|---|---|---|---|
| DE | 2434314 | | 1/1976 | |
| EP | 0052734 | | 6/1982 | |
| GB | 2051200 | * | 1/1981 | 52/192 |
| WO | WO9307072 | | 4/1993 | |

* cited by examiner

*Primary Examiner*—Winnie S. Yip
(74) *Attorney, Agent, or Firm*—Kirkpatrick & Lockhart LLP; Anthony H. Handal

(57) ABSTRACT

To produce a silo or tank, plates provided with joining flanges are made, both plates and flanges being produced from aluminium alloy. The plates are joined to one another in order to form rings, and said rings are joined to one another in order to form a silo or tank. In order to make the said joins between the shaped plates and between the rings watertight, according to the present invention sealing mastic is applied in a channel formed by two adjoining recesses, each made in the outward-facing free end of one of two flanges engaging on one another.

20 Claims, 2 Drawing Sheets

METHOD FOR PRODUCTION OF A SILO

BACKGROUND OF THE INVENTION

The invention relates to a method for the production of a silo or tank from an aluminium alloy, which silo or tank is made up of a number of rings joined to one another, each of which rings is made up of a number of ring segments which are provided around their periphery with a joining flange extending perpendicularly to the segment concerned, comprising:

forming cylinder segments from plates with joining flanges welded to the periphery thereof, which plates and flanges have been produced from an aluminum alloy, combining a number of cylinder segments to give a desired number of cylindrical rings by joining flanges, which have been made on the straight peripheral edges of the segments and engage on one another, to one another by means of a mechanical joining means, such as a rivet, nail or bolt, combining a number of rings formed in this way to give a cylindrical tank or silo wall by joining flanges, which have been made on the curved peripheral edges of the sides and which engage on one another, to one another by means of a mechanical compression means, such as a rivet, nail or bolt, and making the said flange joints watertight.

Such a method is disclosed in U.S. Pat. No. 4,718,208. The seams between the said flanges engaging on one another must be made watertight. In order to achieve this it is customary to weld either the flanges of the cylinder segments or the wall sections themselves to one another.

BRIEF SUMMARY OF THE INVENTION

Apart from the fact that this is a time-consuming task, expensive equipment is needed for this. This can be highly disadvantageous, especially if the silo has to be assembled on site.

The aim of the present invention is to provide a method for watertight sealing of a silo or tank which renders welding at the assembly site superfluous.

In order to achieve this sealing mastic is applied in channels formed by two adjoining recesses made in adjoining corners of two flanges engaging on one another, which corners—as seen in the radial direction of the silo—have a position furthest from the centre line of the silo.

Because, according to the method described, the seals are made watertight by means of a sealing mastic, it is no longer necessary to have welding equipment on hand at the assembly site. All hat is needed is a mastic gun, which is appreciably lighter and smaller than welding equipment. The costs of such guns are also order of magnitude lower than those of welding equipment To provide the joint between the flanges of the segments with adequate rigidity, according to the invention the flanges of the segments are preferably joined with the aid of a bolt. Riveting can usually suffice for the mechanical joint between the flanges of rings engaging on one another.

The present invention provides a channel to contain the sealing mastic, which channel is formed by two identical recesses in the flanges which extend over the entire length of the flanges and which are located at the front edge of the free ends of the respective flanges and which channel extends into the engagement surface of the flanges.

By this means it is possible to fit the rings first, before the mastic is applied. Because the mastic is visible, the mastic seam can be checked simply and non-destructively. Should it be necessary to replace the mastic seam, the old mastic can be removed and new mastic applied without moving the rings.

It is pointed out that DE-A 2 434 314 describes a silo made of an aluminium alloy, which silo is made up of a number of cylindrical rings which are provided around their peripheral edges with a flange extending perpendicularly to the rings concerned. The rings are combined to form a cylindrical silo wall by joining flanges engaging on one another to one another by means of a threaded bolt or the like, maximum tensile stresses in the region of the joint faces between the flanges being ensured by the choice of the thickness of the flanges and the threaded bolts. A leak-free seal can be obtained without welding by adding packing in the form of O-rings between those faces of the flanges which are in contact with one another. This packing in the form of O-rings cannot be replaced without dismantling the silo into cylindrical rings. This known silo lacks adjoining recesses filled with sealing mastic and made in adjoining corners of two flanges engaging on one another, which corners—as seen in the radial direction of the silo—have a position furthest from the centre line of the silo. Moreover, the cylindrical rings are not made up of segments joined to one another by vertical seams.

BRIEF DESCRIPTION OF THE SEVERAL VIEWS OF THE DRAWINGS

The invention will be described in more detail below with reference to the drawings, in which the following shown.

DETAILED DESCRIPTION OF THE INVENTION

Figure 1:
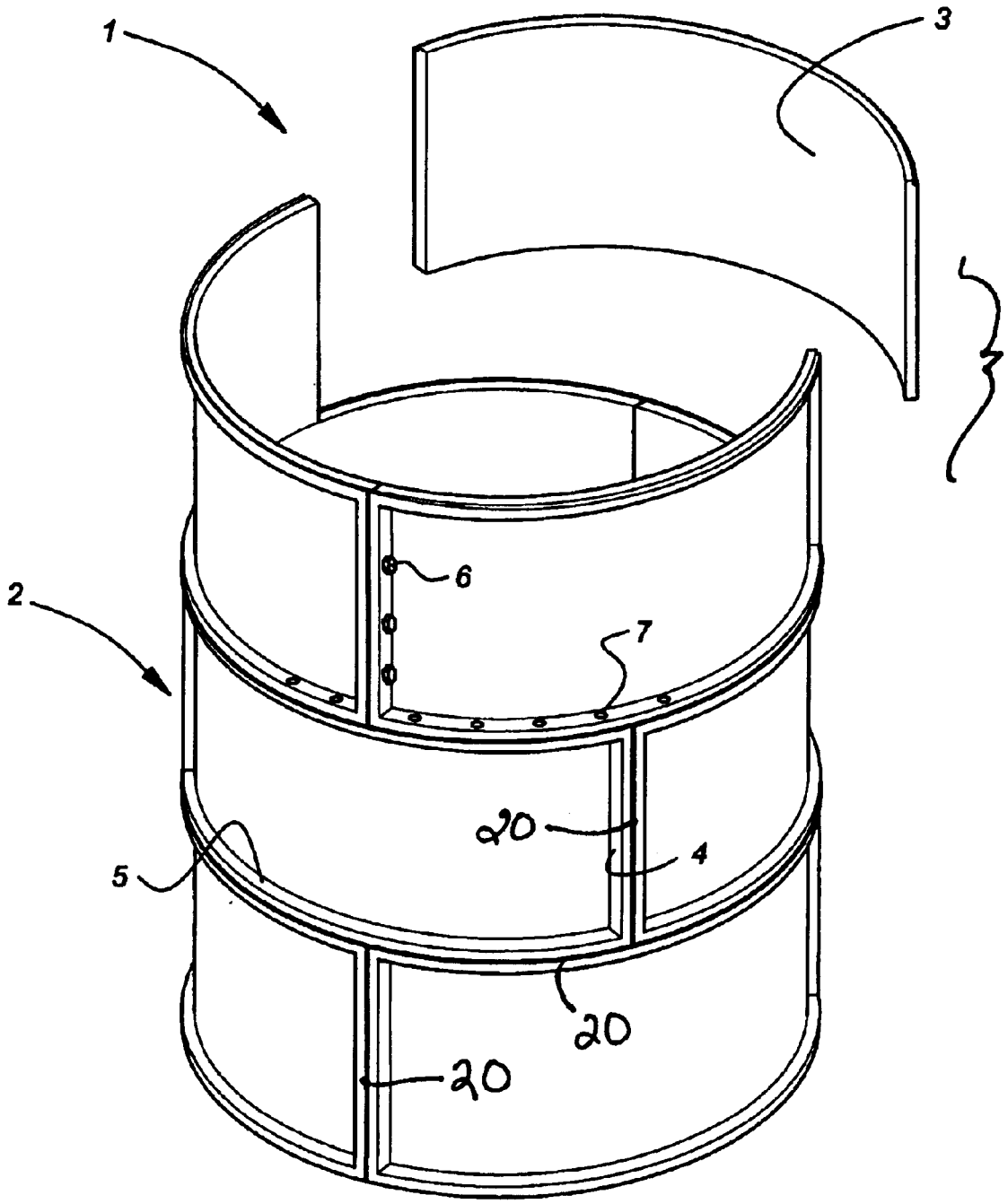
FIG. 1 perspective view of a silo which consists of rings stacked on top of one another and joined to one another, which rings are formed from cylinder segments.

FIG. 1 shows a silo 1 which is made up of rings 2, formed from cylinder segments 3. The rings are formed by joining several cylinder segments 3 to one another by means of straight joining flanges 4, for example with the aid of bolts 6. The rings are joined to an adjoining ring or other element of the silo by means of the curved joining flanges 5 of the cylinder segments, for example with the aid of rivets 7.

Figure 2:
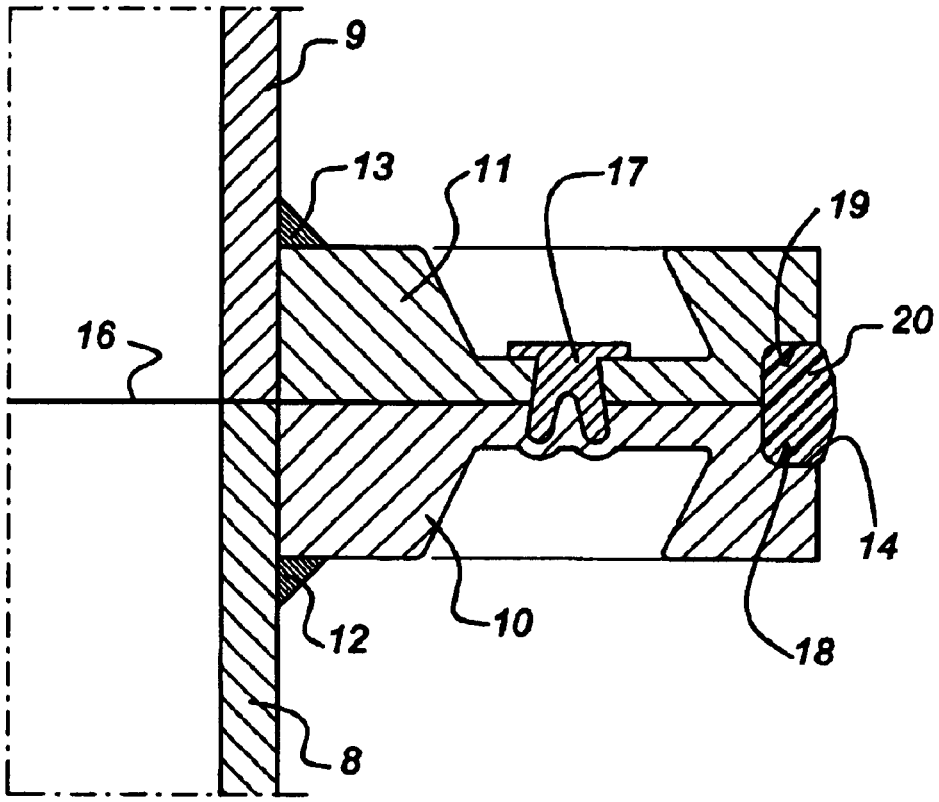
FIG. 2 cross-section of a coupling between two cylinder segments by means of a joining flange according to the present invention.

FIG. 2 shows a cross-section of a join between two cylinder segments, which join can be either a curved or a straight join. The joining flange 10, which extends essentially at right angles from the wall 8, is attached to the wall 8 by means of a weld seam 12. The adjoining wall 9 is provided with a joining flange 11 in a similar manner via weld seam 13. The two cylinder segments are essentially held in place with respect to one another by the mechanical joining means 17, which, for example, can be a rivet, nail or bolt. Joining flange 10 is provided at its free end with a recess 18 which adjoins a similar recess 19 in the adjoining joining flange 11. Sealing mastic 20, which can be silicone-based, is applied in the channel 14 that is formed by the two recesses 18, 19, in order to make the seam 16 watertight.

What is claimed is:

1. A method for the production of a cylindrical silo or tank from an aluminum alloy, the silo or tank comprising a plurality of aluminum alloy rings joined with one another, each said ring having a number of ring segments, each ring segment having a recessed peripheral joining flange extending outwardly of the respective ring, each peripheral joining flange having a curved recessed flange portion and a pair of recessed transverse flange portions extending transversely of the respective ring wherein, when the ring segments and rings are assembled, the recessings of adjacent curved and adjacent transverse flange portions cooperate to provide outwardly facing channeling, the method comprising the elements of:

a) assembling the ring segments to provide the rings by forming a mechanical joint between adjacent transverse flange portions of adjacent ring segments at a location inwardly of the channeling employing one or more mechanical joining elements;

b) assembling the plurality of rings formed in element a) to provide the cylindrical tank or silo wall by forming a mechanical joint between the curved flange portions of adjacent ring segments at a location inwardly of the channeling employing one or more mechanical joining elements; and c) applying sealing mastic in the channeling to form a seal between the joined peripheral flanges outwardly of the mechanical joints formed in elements a) and b).

2. A method according to claim 1 wherein the sealing mastic is a silicone mastic.

3. A method according to claim 1 wherein the mechanical joining elements comprise rivets, nails or bolts.

4. A method according to claim 1 wherein the transverse flange portions are straight.

5. A silo or tank produced by the method of claim 4.

6. A method according to claim 1 wherein the ring segments include ring segments having a pair of said curved flange portions, the transverse flange portions each extending between the curved flange portions.

7. A method according to claim 5 wherein the peripheral flange portions of the ring segments having a pair of curved flange portions extend continuously around the respective ring segment.

8. A silo or tank produced by the method of claim 7.

9. A method according to claim 7 wherein the sealing mastic extends continuously along the channeling and provides watertight sealing of the silo or tank.

10. A method according to claim 1 wherein the recessing is formed in outward facing free ends of each peripheral joining flange.

11. A method according to claim 1 wherein the mastic is applied without moving the silo or tank.

12. A method according to claim 1 wherein the sealing mastic is a silicone mastic, the mechanical joining elements comprise rivets, nails or bolts, the transverse flange portions are straight and extend perpendicularly to the curved flange portions, the ring segments include ring segments having a pair of said curved flange portions, the transverse flange portions each extending between the curved flange portions, the peripheral flange portions of the ring segments having a pair of curved flange portions each extends continuously around the respective ring segment and the recessing is formed in outward facing free ends of each peripheral joining flange.

13. A silo or tank produced by the method of claim 12.

14. A silo or tank produced by the method of claim 1.

15. A method according to claim 1 wherein the channeling between adjacent curved flanged portions meets the channeling between adjacent transverse flange portions.

16. A method according to claim 1 comprising performing element a) so that the segments of one ring are staggered with respect to the segments of an adjacent ring and the transverse flange portions of the one ring are not aligned with the transverse portions of the adjacent ring.

17. A silo or tank produced by the method of claim 16.

18. A method according to claim 1 effected with a mastic gun and without employing welding equipment or welding between the ring segments.

19. A method according to claim 1 further comprising visually and non-destructively checking the sealing mastic, removing old mastic and applying new mastic without moving the rings.

20. A silo or tank produced by the method of claim 9.

* * * * *